United States Patent [19]

Vollmar

[11] Patent Number: 4,816,143

[45] Date of Patent: Mar. 28, 1989

[54] METHOD FOR CONTINUOUS SEPARATION OF MAGNETIZABLE PARTICLES AND APPARATUS FOR PERFORMING THE METHOD

[75] Inventor: Horst-Eckart Vollmar, Möhrendorf, Fed. Rep. of Germany

[73] Assignee: Siemens Aktiengesellschaft, Berlin and Munich, Fed. Rep. of Germany

[21] Appl. No.: 40,576

[22] Filed: Apr. 17, 1987

[30] Foreign Application Priority Data

Apr. 21, 1986 [DE] Fed. Rep. of Germany ..... 3613393

[51] Int. Cl.[4] ..... B03C 1/00

[52] U.S. Cl. ..... 209/212; 55/3; 55/100; 209/214; 209/223.1; 209/228; 209/232; 210/222; 210/695

[58] Field of Search ..... 209/212, 213–215, 209/223.1, 224, 228, 232; 210/222, 223, 695; 55/3, 100

[56] References Cited

U.S. PATENT DOCUMENTS

| | | | |
|---|---|---|---|
| 1,245,717 | 11/1917 | Henderson | 209/224 |
| 2,976,995 | 3/1961 | Forrer | 209/232 X |
| 2,979,202 | 4/1961 | Orbeliani | 209/223.1 |
| 3,382,977 | 5/1968 | Fraas | 209/223.1 X |
| 3,608,718 | 9/1971 | Aubrey, Jr. et al. | 209/223.1 X |
| 3,770,629 | 11/1973 | Nolan | 209/232 X |
| 3,984,309 | 10/1976 | Allen et al. | 209/232 X |
| 4,261,815 | 4/1981 | Kelland | 209/213 |

FOREIGN PATENT DOCUMENTS

| | | | |
|---|---|---|---|
| 0137172 | 4/1985 | European Pat. Off. | 209/223.1 |
| 2444578 | 4/1976 | Fed. Rep. of Germany | 209/232 |
| 0159293 | 3/1983 | Fed. Rep. of Germany | 209/232 |
| 54-0350 | 1/1979 | Japan | 55/100 |
| 54-53695 | 4/1979 | Japan | 55/100 |
| 62-61655 | 3/1987 | Japan | 55/3 |
| 0597645 | 3/1978 | U.S.S.R. | 210/222 |
| 0223825 | 6/1978 | U.S.S.R. | 55/3 |
| 1015911 | 5/1983 | U.S.S.R. | 209/223.1 |
| 1096000 | 6/1984 | U.S.S.R. | 55/100 |

OTHER PUBLICATIONS

Publication IEEE Transactions on Magnetics, vol. MA-G-19, No. 5, Sep. 1983, pp. 2127–2129 "Designing HGMS Matrix Arrays for Selective Filtration" (deLatour et al).

*Primary Examiner*—Johnny D. Cherry
*Assistant Examiner*—Edward M. Wacyra
*Attorney, Agent, or Firm*—Herbert L. Lerner; Laurence A. Greenberg

[57] ABSTRACT

A method for continuous separation of magnetizable paramagnetic and/or diamagnetic particles from a flowing fluid laden with the particles includes guiding the flow through a separation region, penetrated by a high-gradient magnetic field along a primary flow route. The particle-laden fluid flow of the separation region is supplied in the form of a multiplicity of partial flows, each passing through feed zones supplied from the direction of the outer periphery of the separation region and through feed openings of flow guiding bodies. The feed openings are distributed over the cross section of the separation region in the form of at least one feed hole field. The partial flows are then guided inside the separation region through at least one separation hole field of pole element orifices distributed over the cross section of the separation region and associated wall parts which are penetrated by the primary magnetic flux in the direction of the axes of their orificies. The partial flows are then divided into a first branch flow upon which attractive forces from the gradient field of the pole element are exerted in the direction toward the pole element orifices and a second branch flow upon which repulsive forces are exerted from the gradient field of the pole element in a direction away from the respective pole element orifice. The apparatus includes a hole-plate-type fine structure for a flow guiding matrix of the pole elements and for the guiding hole fields.

27 Claims, 8 Drawing Sheets

METHOD FOR CONTINUOUS SEPARATION OF MAGNETIZABLE PARTICLES AND APPARATUS FOR PERFORMING THE METHOD

Specification:

The invention relates to a method for the continuous separation of magnetizable paramagnetic and/or diamagnetic particles from a flow of fluid laden with the particles, the flow being guided through a separation region and penetrated by a high-gradient magnetic field, along a main flow route. The high-gradient magnetic field is generated by a multiplicity of ferromagnetic pole elements which are disposed inside the separation region in a flow guiding matrix and are penetrated by the magnetic flux of an external high-powered magnet thereby reshaping the primary magnetic flux of the external high-powered magnet into a multiplicity of partial fluxes with non-homogeneous field distribution, corresponding to the number and configuration thereof. The fluid flow contains at least two groups of particles. The respective magnetic susceptibility $X_1$ or $X_2$, with respect to the particular $X_F$ of the fluid, being distinguishible from one another in such a manner that because of differently dimensioned magnetic dipole moments of the particles in the fluid flow in the separation region, one group of particles is deflected in a first branch flow in the direction of increasing field gradients and the other group is deflected in a second branch flow in the direction of decreasing field gradients, or at least one group is deflected as a first branch flow to a greater extent than the other group as a second branch flow, in the direction of increasing or decreasing field gradients. Furthermore, both of the at least two branch flows are separated from one another and the first branch flow, while enriched with the first group of particles, is supplied to a first collecting line and the second branch flow, while enriched with the second group of particles, is supplied to a second collecting line.

A method of a different generic type which is also known, is used predominantly for kaolin cleaning, and operates cyclically using high-gradient magnet separators rather than continuously. The magnetizable particles are deposited on a steel wool filling, so that the steel wool must therefore be flushed cyclically. Due to the short cycling times, it is not economical to process substances having a high proportion of magnetizable particles.

High-gradient magnetic separators in a carousel structure are also known and operate by a method which not of the same generic type as the invention, namely a discontinuous method. These separators have a complicated coil construction, and they make relatively poor use of the volume filled by the magnetic field. Furthermore, large masses must be moved through the magnetic coils.

Finally, magnetic separators operating by another non-generic method, namely the OGMS method (Open Gradient Magnetic Separation), are also known. Such separators operate continuously and the field gradients therein are generated by superconducting coils that are excited in opposite directions. However, because the force densities are smaller by approximately 2 orders of magnitude as compared with a method of the same genus as the invention, these separators are suitable only for separating relatively large, highly paramagnetic particles.

U.S. Pat. No. 4,261,815 discloses a method of the same generic type as the invention which is used for continuous magnetic separation with high field gradients. The magnetic separator apparatus disclosed for performing this method is in the form of a first matrix of wires that are perpendicular to the magnetic field, for generating field gradients and deflecting particles and a second grid matrix for separation of the flows of particles flowing in the direction of the wires. The first and second matrix form the flow guiding matrix, and the main problem in this apparatus is the difficulty of manufacturing the great number of axially disposed thin wires, which have a diameter of 0.2 mm, for example, and are spaced apart from one another by 2 mm, for example. The high-powered magnetic field penetrates the tubular magnetic separator crosswise to the axis and the housing of the magnetic separator is accordingly formed of nonmagnetic material. Due to the complicated interior configuration of the device, a method using such a magnetic separator is relatively vulnerable to becoming dirty during continuous operation and accordingly is likely to malfunction.

A second variation of a flow guiding matrix for the separation method of the above-mentioned U.S. patent has been published in the journal "IEEE Trans. Magn." MAG 19, 2127 (1983) and likewise is formed of a wire grid matrix, in which the magnetic field is applied perpendicular to the direction of the wires and the particle flow is either in the direction of the wires or axially parallel thereto. In this second variation, the separation of the particles through repulsive magnetic forces is also mentioned. The zone of attractive forces is covered by plates formed of non-magnetizable material. The problems mentioned above with respect to the first variation according to this U.S. patent logically arise in this latter system as well, which has been tested only on a laboratory scale.

It is accordingly an object of the invention to provide a a method for the continuous separation of magnetizable particles and an apparatus for performing the method, which overcome the hereinafore-mentioned disadvantages of the heretofore-known methods and devices of this general type, which solves the problem of the continuous concentration of magnetizable particles in the force zone of the high-gradient magnetic separators in sturdier fashion, with less tendency toward clogging and which attains better efficiency as an overall result.

With the foregoing and other objects in view there is provided, in accordance with the invention, a method of continuously separating magnetizable paramagnetic and diamagnetic particles including at least two groups of magnetizable particles having different respective magnetic susceptibilities, from a flowing fluid laden with the particles, which comprises: guiding a fluid flow containing the at least two groups of particles through a separation region along a primary flow route, penetrating the flow with magnetic flux from an external high-powered magnet, guiding and reshaping the magnetic flux with a multiplicity of ferromagnetic pole elements disposed inside the separation region in a flow guiding matrix, in the following manner: penetrating the ferromagnetic pole elements with magnetic flux reshaping the primary magnetic flux of the external high-powered magnet into a multiplicity of partial fluxes with non-homogeneous field distribution, corresponding to the number and distribution of the ferromagnetic pole elements, and thereby forming a high-gradient magnetic field with regions of increased and decreased density of magnetic flux lines; distinguishing the respective magnetic susceptibility $X_1$ or $X_2$ of the at least two groups of particles from one another with respect to the particular $X_F$ of the fluid by deflecting one group of particles in a first branch flow in the direction of increasing field gradients, and deflecting the at least one other group in a second branch flow in the direction of decreasing field gradients, at least deflecting one group as a first branch flow to a greater extent than the at least one other group as a second branch flow, in the direction of increasing or decreasing field gradients due to differently dimensioned magnetic dipole moments of the particles in the fluid flow in the separation region; and which further comprises: supplying the particle-laden fluid flow through feed zones supplied from the direction of the outer periphery of the separation region and through feed openings in flow guiding bodies distributed over the cross section of the separation region in the form of at least one feed hole field to the separation region in the form of a multiplicity of partial flows; subsequently guiding the partial flows inside the separation region through at least one separation hole field of pole element orifices distributed over the cross section of the separation region and associated wall parts of a ferromagnetic pole element as a flow guiding matrix, penetrating the flow guiding matrix with the primary magnetic flux in the direction of the axes of their orifices, and dividing each of the partial flows containing at least two groups of particles into the at least two branch flows with the pole element orifices of the flow guiding matrix corresponding with the respective adjacent feed openings as follows: a first branch flow, upon which attractive forces from the gradient field of the pole element are exerted in the direction toward the pole element orifices: and a second branch flow, upon which repulsive forces are exerted from the gradient field of the pole element, in a direction away from the respective pole element orifice: supplying the first branch flows flowing through the pole element orifices and enriched with the first group of the at least two groups of particles to first collecting chambers communicating on the outlet side with the pole element orifices; supplying each of the second branch flows deflected by the pole element orifices and enriched with the second group of the at least two groups of particles to second collecting chambers, each of which encompass the flow volume in the separation region between the feed hole field and the separation hole field without the first branch flows entering into the pole element orifices: supplying the first and second branch flows, each reunited in the first and second collecting chambers as collected first and second branch flows, to one of at least one first and at least one second collecting line, and supplying the collected first branch flow enriched with the first group of particles to a first main collecting line, and supplying the second collected branch flow enriched with the second main group of particles to a second collecting line.

The advantages attainable with this method are above all that in order to practice the invention, relatively sturdy perforated plates can be used for the hole fields. Inducing the high-gradient magnetic field with its lines of force rectified with respect to the direction of the main flow route or in the axial direction of the pole element orifices makes it possible to use cylindrical high-power solenoid coils with an extremely favorable field induction into the interior of the separating region. The method can be performed continuously with high throughput and a considerably reduced danger of stoppage.

With the objects of the invention in view there is also provided an apparatus for continuously separating magnetizable paramagnetic and diamagnetic particles including at least two groups of magnetizable particles having different respective magnetic susceptibilities, from a flowing fluid laden with the particles, comprising: at least one separator container through which the fluid flow laden with particles continuously flows in at least one first and one second group along a primary flow route having two ends; the at least one separator container including: at least one separation region disposed therein, an outer periphery, at least one connection for feeding the fluid flow at one of the ends of the flow route, and a fluid flow outlet divided into at least two collecting lines at the other of the ends of the flow route; one of the collecting lines transporting a fluid flow fraction enriched with one of the at least two particle groups and the other of the collecting lines transporting a fluid flow fraction enriched with another of the at least two particle groups; a flow guiding matrix disposed inside the separation region including: at least one separation hole field having a multiplicity of ferromagnetic pole elements with pole element orifices having axes and being distributed over the cross section of the separation region reshaping a high-gradient magnetic field, and a flow guiding body having ferromagnetic pole element wall parts distributing the two branch flows, variously deflected at the gradient fields of the pole elements to the associated collecting lines; a high-powered magnet disposed at the outer periphery of the separator container, generating a primary magnetic flux being oriented in the axial direction of the pole element orifices penetrating the separation region and the pole elements disposed therein for forming non-homogeneous partial fluxes at the individual pole elements; the first particle group of the at least two groups having a first magnetic susceptibility $X_1$ and the second particle group having a second magnetic susceptibility $X_2$ differing in terms of the magnetic susceptibility $X_F$ of the fluid, in such a manner that magnetic deflection forces of different strengths are exerted by the gradient fields of the pole elements upon the two groups of particles, due to different magnetic dipole moments; another flow guiding body disposed upstream of and spaced apart from the flow guiding matrix including at least one feed hole field plate having feed openings formed therein corresponding to the pole element orifices dividing the fluid flow flowing toward the feed perforation plate from the outer periphery of the separation region through feed zones into partial flows flowing to the pole element orifices; at least one first collecting chamber having an inlet side communicating with the pole element orifices and being connected to one of the at least two collecting lines; and a second collecting chamber defined by a flow volume between the feed perforation plate of the diamagnetic flow guiding body and the separation hole field of the pole element wall parts being connected to the other of the at least two collecting lines.

Other features which are considered as characteristic for the invention are set forth in the appended claims.

Although the invention is illustrated and described herein as formed in a method for the continuous separation of magnetizable particles and an apparatus for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

The apparatus shown in FIGS. 1–8 performs the method according to the invention. The centerpiece of this apparatus for a continuous magnetic separator is a perforated-plate-like fine structure, which not only serves to separate necessary magnetic field gradients but also separately guides the partial flows that are enriched with magnetizable material and those depleted of magnetizable material.

Figure 1:
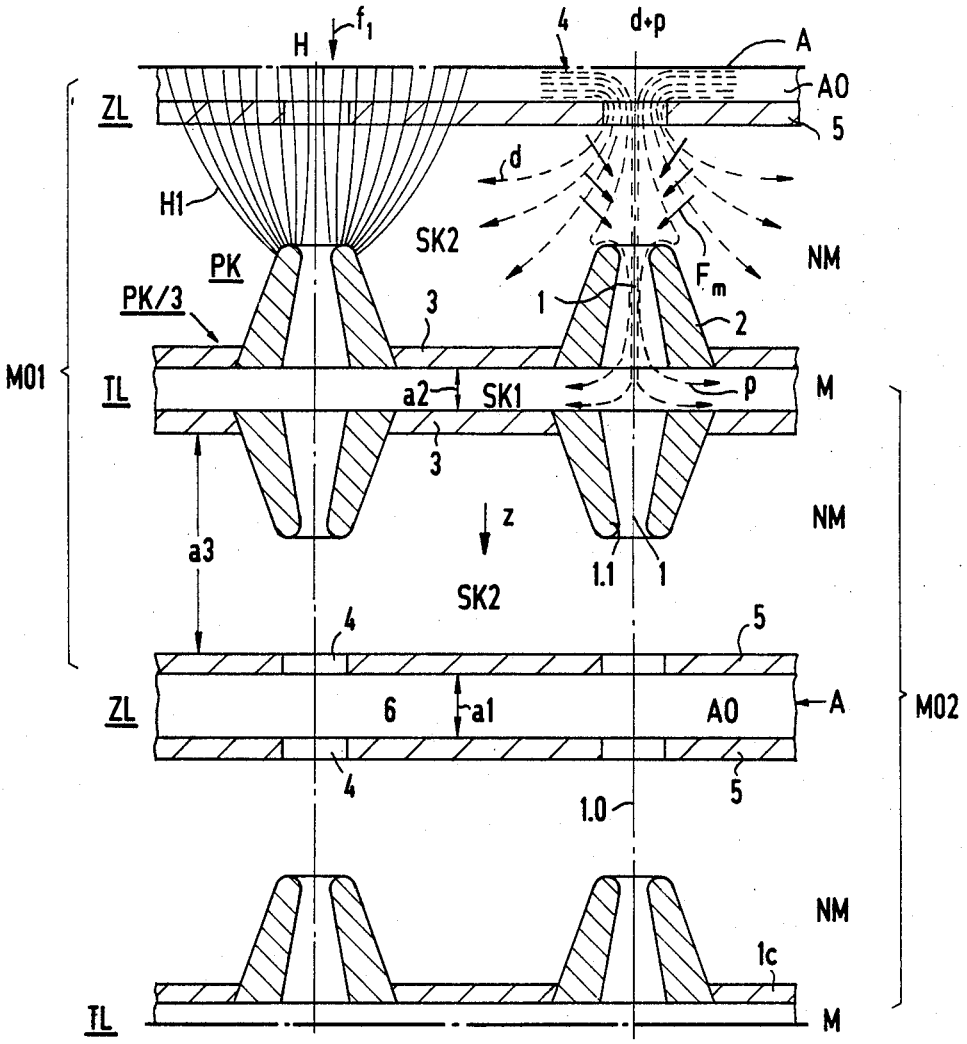
FIG. 1 is an enlarged, fragmentary, diagrammatic, cross-sectional view of a first embodiment of a separation structure disposed in the interior of a separation tube, having a flow guidance matrix formed of pole element orifices, pole element wall parts and connecting perforated plate wall parts, as well as corresponding feed hole fields.

Referring now to the figures of the drawings in detail and first, particularly, to FIG. 1 thereof, it is seen that a fine structure of the flow guiding matrix has separation hole fields, which are identified as a whole by reference symbol TL and feed hole fields or field plates ZL disposed therebetween in the direction of a primary flow route z. Pole element orifices 1 and pole element wall parts 2 defining the orifices are formed of a fine structure, in the manner of a perforated plate, having hollow-cone-shaped protruding nozzles in the hole region. The pole element wall parts 2 are formed of ferromagnetic material, while remaining wall parts in the form of perforated plates 3 of the perforated-plate-like fine structure are formed of non-magnetizable or diamagnetic, or weakly paramagnetic material. Another perforated-plate-like fine structure for the feed hole fields ZL has pairs of perforated plates 5 each being spaced apart in planar parallel fashion from one another and being disposed with the feed openings 4 thereof congruent to the pole element orifices. The intervening space 6 between the paired perforated plates 5, 5 serves as a feed zone for the particle-laden fluid flow A.

Similarly, in the case of the flow guiding matrix formed of the separation hole fields TL, the perforated plates 3 are stacked one above the other in pairs, particularly in mirror symmetry with one another, in such a manner that the pole element orifices 1 and the pole element walls 2 are each located along a common axis. In the upper left pole element configuration, the drawing diagrammatically shows the field which is indicated as a whole by reference symbol H, that is narrowing as generated by the pole elements or bodies indicated as a whole by reference symbol PK. The primary flux direction of the field H points in the direction of an arrow $f_1$. Due to the local rotational symmetry, the field narrowing takes place even more narrowly than is shown in FIG. 1, in fact it occurs two-dimensionally. On the right, next to the diagrammatically illustrated field course, the flow direction of the arriving particle-laden fluid flow A is diagrammatically represented by broken lines. The magnetic forces acting upon paramagnetic particles are indicated by arrows $F_m$ and they effect a concentration of the paramagnetic particles in the core flow flowing into the pole element orifices, while a partial flow d remaining between the perforated plate 5 and the separation hole field TL or between the associated pole elements PK and perforated plates 3, is depleted of paramagnetic particles. The partial flow d will be referred to as the second branch flow and a branch flow p deflected into the pole element orifices 1 will be referred to as the first branch flow. For diamagnetic particles, the magnetic forces illustrated by arrows $F_m$, which coincide with the corresponding gradient field, act in the opposite direction, so that the result is a depletion of diamagnetic particles in the core flow or first branch flow p.

Accordingly, the perforated plates 5 of the feed hole fields ZL, like the perforated plate wall parts 3, are formed of nonmagnetic material or diamagnetic, or weakly paramagnetic material. The perforated plates 5 are spaced apart by a distance a1 from one another and between them they form a feed zone A1. The perforated plates 3 of the flow guiding matrix, which are identified as a whole as reference symbol PK/3, are likewise spaced apart from one another by a distance a2. This intervening distancing space forms a first collecting chamber SK1 for the first branch flows p, which are identified by reference numeral M in collected form. The flow zone disposed between the perforated plate 5 and the flow guiding matrix PK/3 is a second collecting chamber SK2 for the fraction or second branch flow d depleted of paramagnetic particles. The second partial flows produce a total flow NM in the second collecting chamber SK2.

Figure 2:
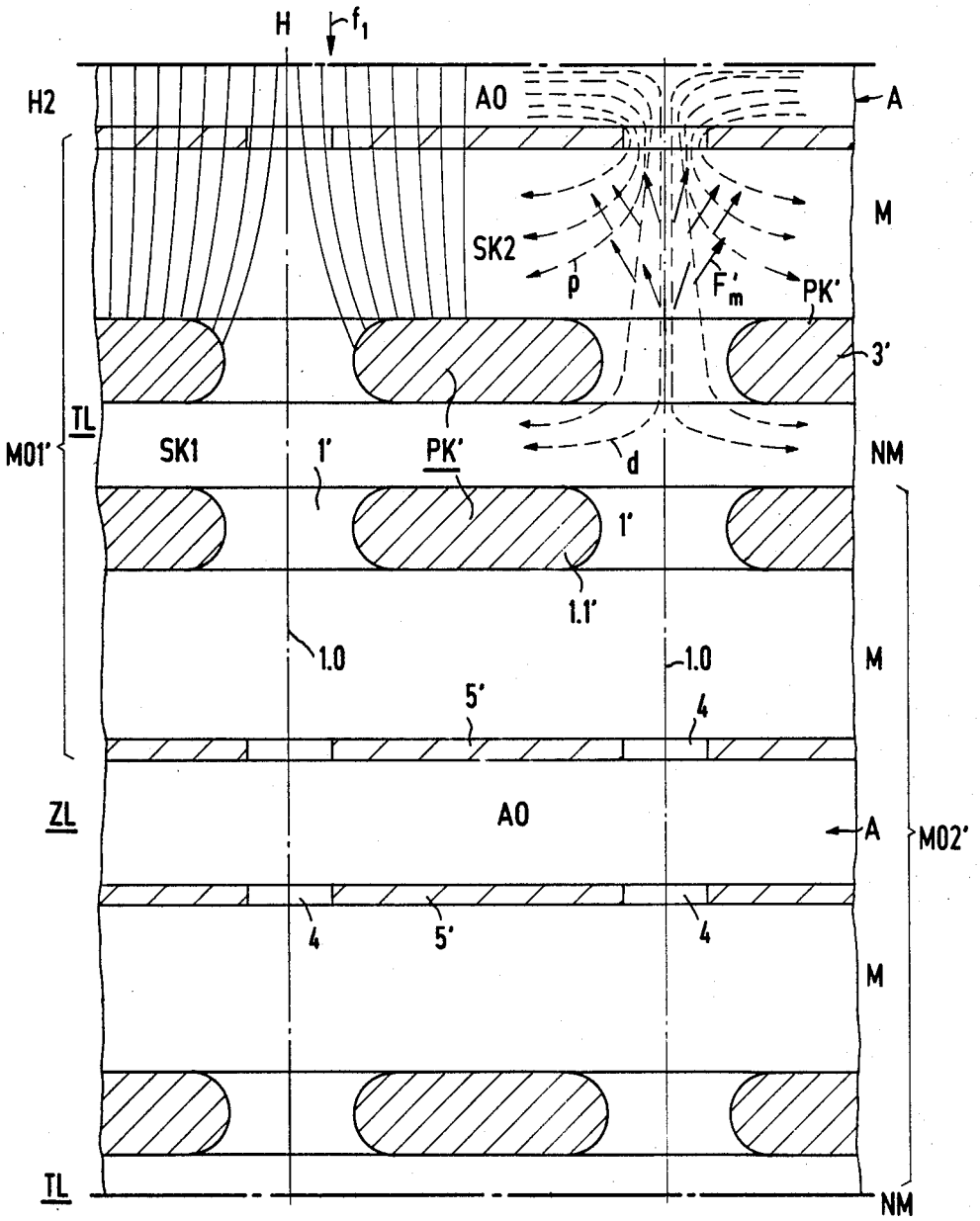
FIG. 2 is a view similar to FIG. 1 of a second embodiment of the device, in which the pole element orifices are not in the form of nozzle elements but rather openings in flat perforated plates.

A structure which is a variation of the fine structure shown in FIG. 1 but which operates with repulsive forces for paramagnetic particles rather than attractive forces, is shown in FIG. 2. The structure is formed of two pairs of perforated plates 3', 3' stacked one above the other, the particle-laden fluid flow A being supplied between pairs of thin perforated plates 5', 5' of non-magnetizable material, and the fraction d depleted of paramagnetic particles is removed between the sturdier perforated plates 3', 3' forming the collecting chamber SK1 that are made of ferromagnetic material, while on the other hand, the fraction enriched with paramagnetic particles remains inside the collecting chamber SK2.

For separation, the magnetic field lines are therefore severely attenuated locally, which results in repulsive forces upon paramagnetic particles, which are correspondingly depleted in the core flow d. On the other hand, diamagnetic particles are enriched in the core flow. The advantage of this separation structure is the even further reduced danger of clogging, in the event that a certain proportion of ferromagnetic or highly paramagnetic particles is present in the arriving fluid flow A. Moreover, this separation structure is simpler to manufacture.

Figure 3:
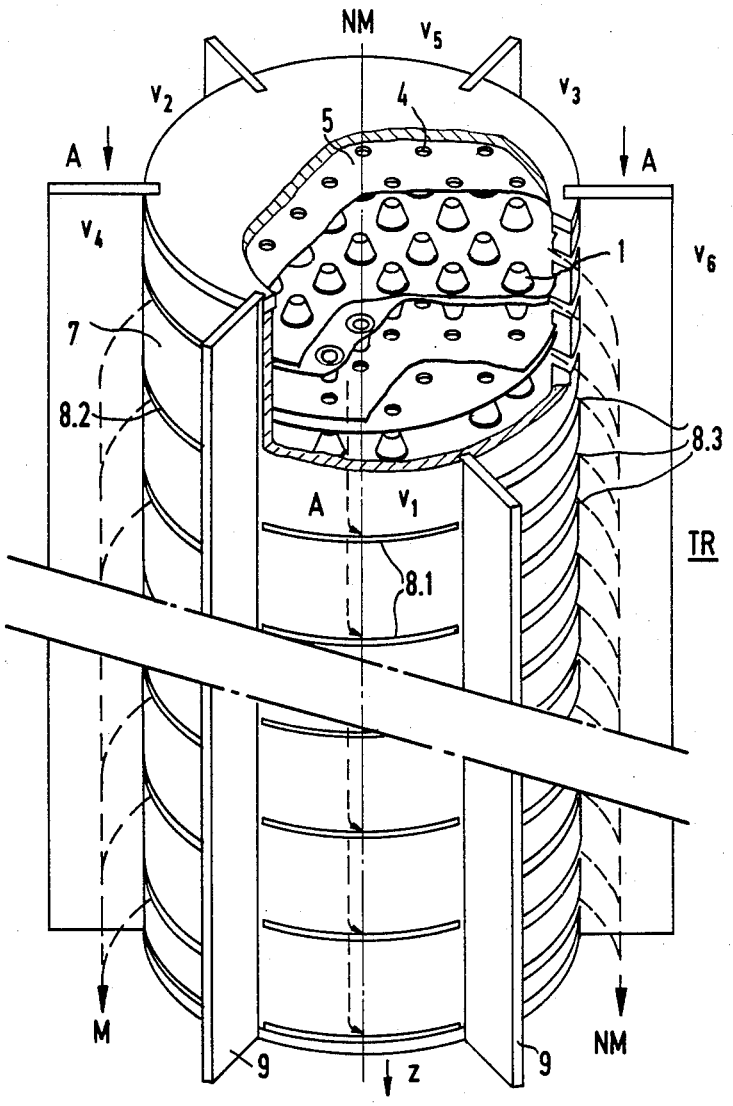
FIG. 3 is a perspective and abbreviated view of a separation tube which has a separation structure as shown in FIG. 1.

As shown in FIG. 3, the perforated plates 3 provided with the pole elements PK or PK' and the perforated plates 5 having the feed openings 4 can be combined into modules and stacked to make a separation tube TR. The separation tube TR is slit segmentally for the supply of the arriving particle-laden fluid flows (in principle, the term "fluid flows" is understood to include not only flows of liquid but gas flows as well) and for shunting the magnetic and the nonmagnetic fractions. The feed openings 4 and the pole element orifices or nozzles 1 are each located one above the other in a hexagonal grid configuration.

Figure 4:
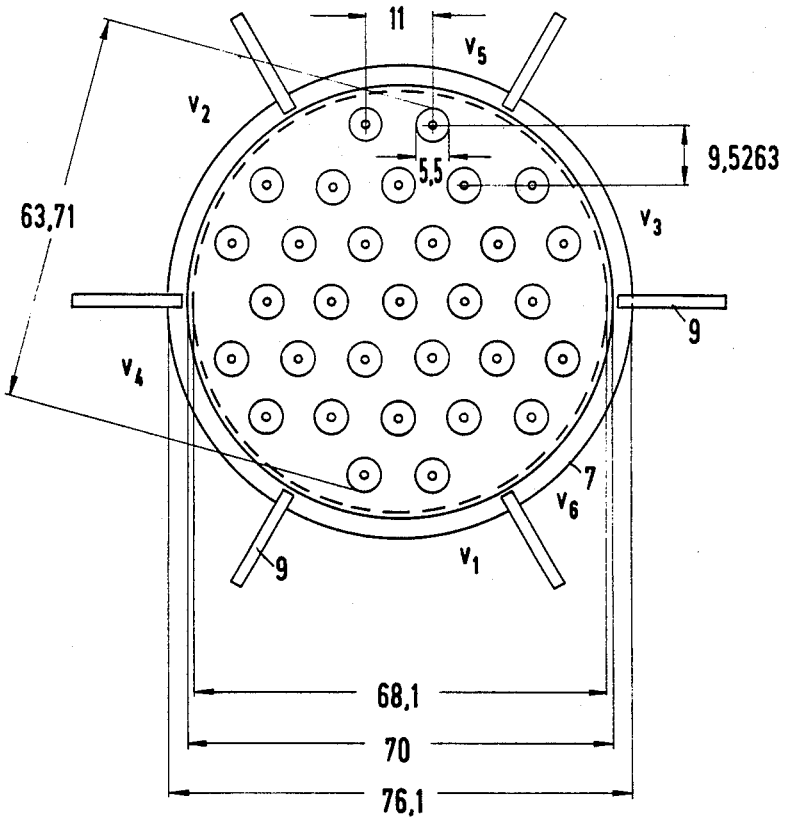
FIG. 4 is a cross-sectional view of the separation tube of FIG. 3, including dimensions which are provided in order to make the size ratio clearer.

FIG. 4 provides examples of favorable dimensions for a single separation tube (given in millimeters).

Figure 5:
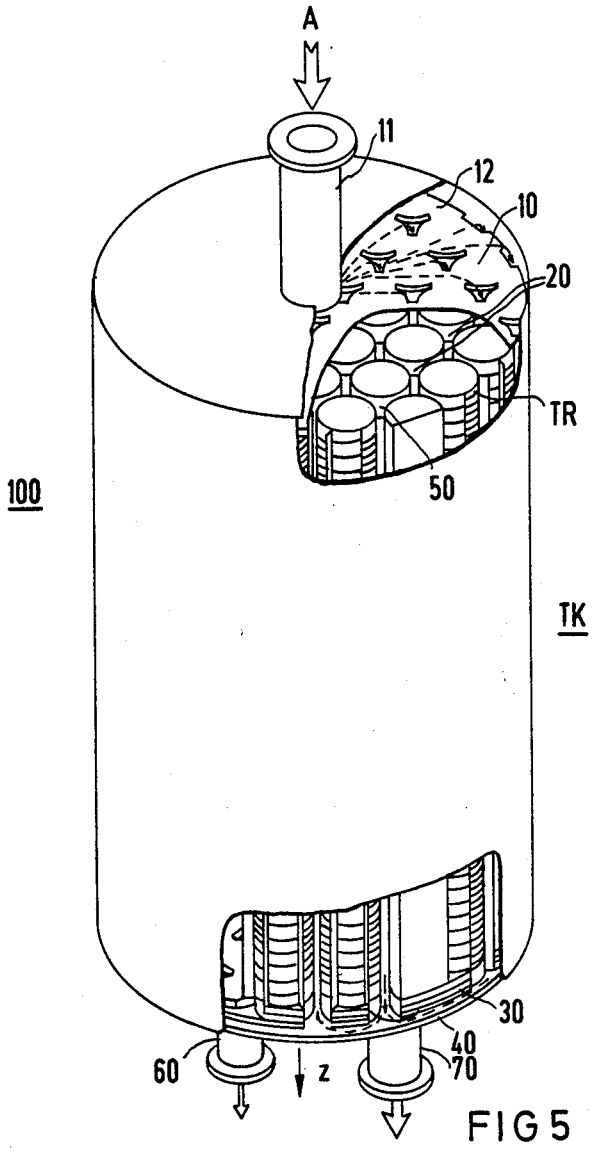
FIG. 5 is perspective view which is partly broken away, of a separation canister formed of a great number of separation tubes as shown in FIGS. 3 and 4.
Figure 6:
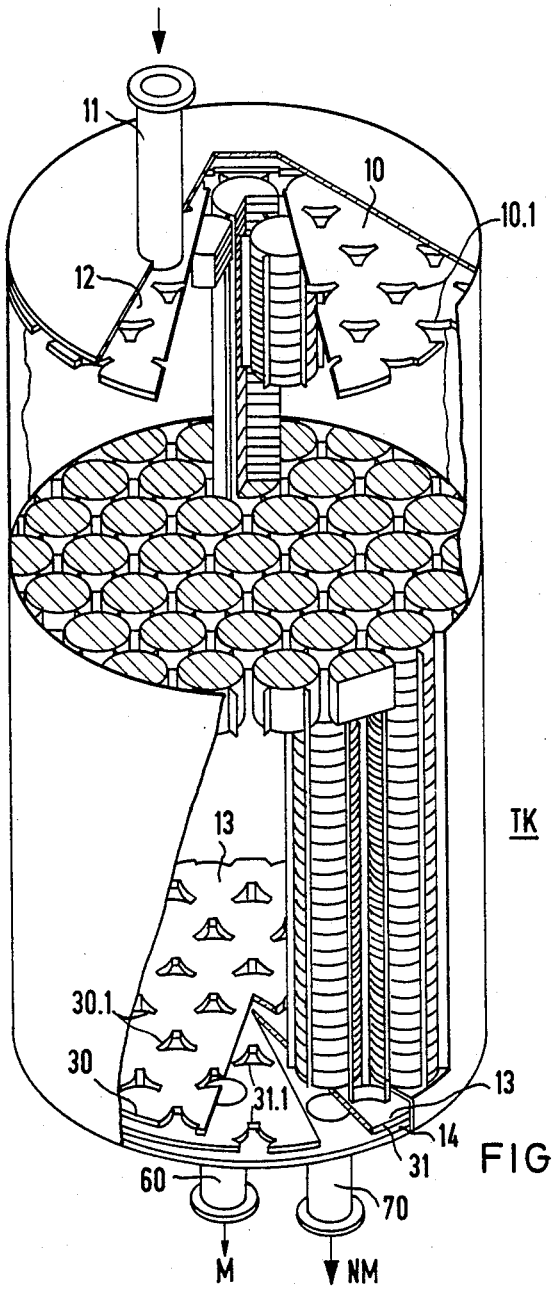
FIG. 6 is a view similar to FIG. 5 on a larger scale, showing a slightly modified version of the separation canister of FIG. 5.

A great number of separation tubes of the type shown in FIG. 3 can be combined into a separation canister, as shown in the perspective views of FIGS. 5 and 6, which together with a non-illustrated solenoid surrounding the separation canister and supply units, forms the magnetic separator.

As shown in FIG. 5, the particle-laden fluid flow is supplied through a pipe fitting 11 of a primary feed line to a separation canister TK and is directed from three sides through a flow induction plate 10 and intervening tube spaces 20, to each separation tube TR, while the nonmagnetic fraction is shunted away separately through the remaining intervening tube spaces. An intermediate flow removal guide plate plate 30 separates the two fractions in such a manner that the channels carrying the magnetic fraction terminate above the intermediate plate 30 and the channels carrying the nonmagnetic fraction terminate below the plate 30. First and the second primary collecting lines 60, 70 for shunting away the two fractions are welded with their respective pipe fittings into the intermediate plate 30 and the base plate 40, respectively.

Figure 8:
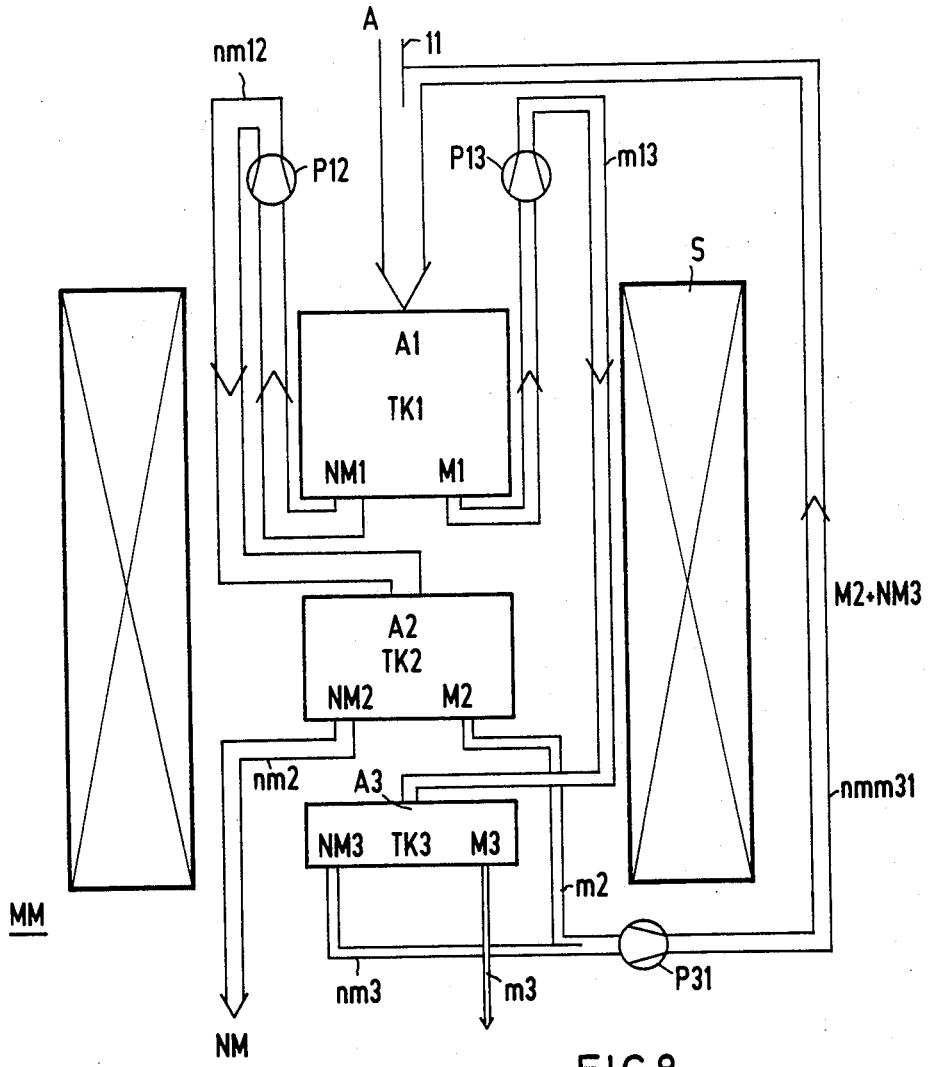
FIG. 8 is a cascade circuit for continuous-operation high-gradient magnetic separators, using three separation canisters of different lengths as shown in FIGS. 5 or 6.

Six fill bodies 50 resulting from the hexagonal configuration of the separation tubes TR can be used as a pipeline in a cascade configuration of the magnetic separator formed of a plurality of separation canisters in the magnetic field of a solenoid S, seen in FIG. 8.

Figure 7:
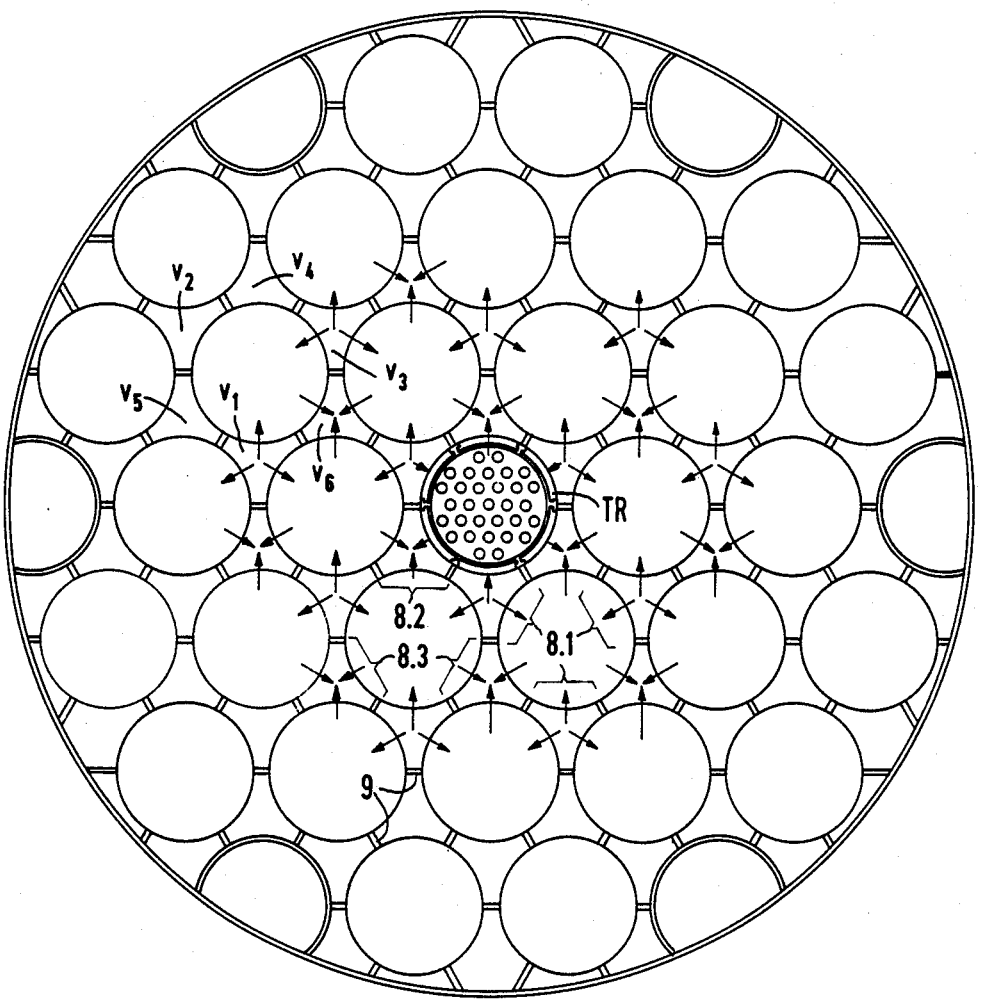
FIG. 7 is an enlarged cross-sectional view of the separation canister of FIG. 6.

The cross-sectional view of FIG. 7 shows the separation tubes TR disposed in a hexagonal grid, inside the separation canister, with only a single separation tube being shown in greater detail.

Within the scope of the invention, both the separation tube TR shown in FIGS. 3 and 4 and the separation canister TK along with their primary flow paths z can be constructed as separator containers. A detailed description of this structure in connection with the embodiment of FIGS. 1, 3 and 4 will first be given. The slits formed by stacking modules MO1 or MO2 seen in FIG. 1 in the direction z, are divided into three groups of slits by bulkhead walls 9 extending radially-axially and provided on the outer periphery, tubular wall or shell 7 of the separation tube TR, as seen in FIGS. 3 and 4. First slits 8.1 are provided for supplying the fluid flow to feed zones AO of the modules from a feed line. The feed line functions are performed in this case by line volumes $v_1$, $v_2$ and $v_3$, which take the form of columns with an annular sector cross section and are each defined between two bulkhead walls 9 in succession in the peripheral direction. In the illustrated embodiment, the bulkhead walls 9 are hexagonally disposed; that is, they are located on radii that open sectors therebetween each having a sector angle of 60 degrees. The three line volumes $v_1$, $v_2$ and $v_3$ are distributed uniformly over the periphery of the separation tube. Between the line volumes $v_1$ and $v_2$, the line volume $v_4$ is located directly in contact with and in communication with second slits 8.2, for removal of the first branch flows M collected in the first collecting chambers SK1 of the modules, seen in FIG. 1. In the case of the second illustrated embodiment of FIG. 2, the first branch flows are designated with reference symbol NM, which will be explained below. The broken line inside the line volume $v_4$ indicates the outlet of the first partial flows M collected in the various modules. Viewed in the clockwise direction, the line volume $v_2$ is followed by the line volume $v_5$, which is followed by the line volume $v_3$ and then the line volume $v_6$. The line volumes $v_5$ and $v_6$ are in contact with and communicate with third slits 8.3: that is, they serve as a collecting line for the collected second partial flows NM radially emerging from the various modules, as indicated by the broken flow line in the right-hand portion of FIG. 3. These collecting lines $v_5$ and $v_6$ thus communicate with the second collecting chambers SK2 seen in FIG. 1.

Returning to the detailed illustration of FIG. 1, it can be seen that the arriving particle-laden fluid flow A is divided through the feed zone AO and the respective feed hole field ZL by the holes 4, into the partial flows p+d, which contain paramagnetic and diamagnetic particles, respectively. The primary flow direction z and the primary field direction of the high-gradient magnetic field H coincide, or extend axially parallel with one another; the aforementioned local gradient fields H1 are then generated by means of the pole elements PK, because the magnetic field lines preferentially enter into these ferromagnetic bodies, resulting in the constrictions and field line compressions shown in FIG. 1. For the sake of simplicity, the first, paramagnetic, particle group as well as the partial flow enriched therewith will be identified with reference symbol p, while the second, diamagnetic, particle group and the partial flow enriched with it will be identified with reference symbol d, in the observations made below. If the first particle group p is assigned a first magnetic susceptibility $X_1$ and the second particle group d is assigned a second magnetic susceptibility $X_2$, which differ from one another and also differ in terms of the magnetic susceptibility $X_F$ of the fluid or carrier fluid, then variously strong magnetic deflection forces can be exerted upon the two groups of particles with the local gradient fields H1 of the pole elements PK, because of the different magnetic dipole moments. In order to attain this deflection process, which has already been explained, a flow guiding matrix PK/3 is formed by at least one separating hole field TL of pole element orifices 1, distributed over the cross section of the separation region, and associated ferromagnetic pole element wall parts 2 of a flow guiding body. As noted, the primary magnetic flux H extends in the axial direction 1.0 of the pole element orifices 1 and hence parallel to the primary flow path or primary flow direction z. At least one feed perforation plate ZL of a further flow guiding body is disposed upstream of and spaced apart by a distance a3 from the flow guiding matrix PK/3. The feed openings 4 of the feed perforation plate ZL correspond with the pole element orifices 1 and in particular are disposed coaxially with these orifices. The feed perforation plate ZL acting as a flow guiding body divides the fluid flow A flowing to it from the outer periphery of the separation region through the line volumes or feed zones $v_1$, $v_2$, $v_3$ seen in FIG. 3, into partial flows p+d flowing to the pole element orifices 1. At least one first collecting chamber SK1 communicates on the outlet side with the pole element orifices 1. The flow volume between the feed perforation plate ZL of the diamagnetic flow guiding body and the separation hole field TL of the pole element wall parts 3 serves as the second collecting chamber SK2. The first collecting chamber SK1 is conncted to a collecting line $v_4$ seen in FIG. 3 and the second collecting chamber SK2 is connected to the other collecting line $v_5$, $v_6$. Accordingly, at least two collecting lines, one for each of the first branch flow p and the second branch flow d, are necessary. As will be explained in further detail below, in the context of combining a multiplicity of separation tubes TR of FIG. 3 into one separating canister TK, the first collecting lines $v_4$ are connected to, or communicate with, the first primary collecting line 60 and the second collecting lines $v_5$, $v_6$ are connected to, or communicate with, these primary lines.

It will be seen from FIGS. 1 and 3 that the pole element orifices 1 and wall parts 3 of the respective separation hole field TL are in the form of by a perforated-plate-like fine structure having hollow-cone-shaped, protruding nozzles PK in the hole region, and the field line compression in the vicinity of the nozzle orifices 1 result in local gradient fields H1, which exert attractive forces on paramagnetic particles flowing in in the direction of the nozzle axis 1.0, as indicated by the arrows $F_m$, and repulsive forces on correspondingly inflowing diamagnetic particles d, so that the core branch flow p entering through the nozzles or pole elements PK, is enriched with paramagnetic particles, while on the other hand the other or second branch flow d that bypasses ahead of the nozzles PK is depleted of paramagnetic particles and enriched with diamagnetic particles. The defining edges 1.1 of the pole element or nozzle orifices 1 are rounded, as illustrated, which is favorable in terms of the course of the field lines and thus improves the separation efficiency. The feed openings 4 of the feed perforation or hole plate ZL are respectively coaxial with the pole element orifices 1 of the separation hole field TL. In particular, a perforated-plate-like fine structure for the pole element orifices 1 and the pole element wall parts 3 of the flow guiding matrix PK/3 is provided in respective pairs with a disposition of the two paired perforated plates 3—3 spaced apart (by a distance a2) from one another in planar parallel fashion and congruent with one another. The intervening space between the paired perforated plates 3—3 serves as the collecting chamber SK1 of the first branch flows p, and the space located outside the perforated plates and bordering on the feed hole fields ZL serves as the second collecting chamber SK2 for the second branch flows d. As shown in FIG. 1, the flow guiding body for the feed hole field ZL is also in the form of a perforated-plate-like fine structure, with a disposition of the two paired perforated plates 5—5 spaced apart (by a distance a1) from one another in planar parallel fashion and congruent with one another, with the intervening space between the paired perforated plates 5—5 serving as the feed zone AO.

A separation effect can already be inherently attained if one feed hole field ZL having a single perforated plate 5 is associated with one separation hole field TL having a single perforated plate 3 with pole elements PK on its pole element side. In this case, as in the ensuing description, however, the term "separation module" should be understood to be the smallest satisfactorily functioning basic unit MO1, disposed in multiples in axial succession in the primary flow direction z, in the context of a separation tube TR. Each of these separation modules MO1 include one pair of perforated plates 3—3 for the flow guiding matrix PK/3 and one perforated plate 5 each for the feed hole fields ZL. On each side of this pair of perforated plates, the plates 5 are disposed in mirror symmetry and spaced apart by the distance a3. These modules MO1, one of which is visible in complete form in FIG. 1, are stacked above one another and spaced apart by distances al such that the feed zones AO are formed by the adjacent perforated plates 5 of the feed hole fields ZL of the successive modules. The separation module MO2 can also be considered as the smallest module unit that is repeated several times or many times, each of them comprising one pair 5—5 of perforated plates for the feed zones AO and one perforated plate 5 each for the separation hole fields TL, spaced mirror symmetrically apart by the distance a3 from either side of the pair 5—5 of perforated plates. These modules MO2 are suitably stacked above one another, spaced apart by distances a2 from the modules MO1, such that the first collecting chambers SK1 are formed by the perforated plates 3—3 of the separation hole fields TL of the successive modules, adjoining one another. As a result of this stacked disposition of the individual modules MO1 and MO2, respectively, there is a two-current inflow, in the direction z and in the direction −z, as well as a two-current outflow in these two directions, thus bringing about very good utilization of the volume of a separation tube TR seen in FIG. 3. Preferably, such a separation tube TR has a circular cross section, so that the hole fields or perforated plates ZL, TL also have a circular outline, as seen in FIG. 3. The separation modules MO1 and MO2 are stacked one above the other in the direction z as shown in FIG. 3 and are mechanically firmly connected to one another to form the separation tube TR (through the use of suitable screw connections or welded connections which are not shown in detail), and the separation modules are surrounded on their outer periphery by the tube wall 7, which is provided with the slits 8.1, 8.2, 8.3, as already noted.

The basic principle of the disposition of the perforated plates explained in conjunction with FIG. 1 is also retained in the second illustrated embodiment of FIG. 2. There, the pole element orifices 1′ and wall plates or parts 3′ of one separation hole field TL are respectively constructed in the form of a perforated-plate-like fine structure in such a manner that the attenuation of field lines in the hole region results in local gradient fields H2, which exert repulsive forces upon paramagnetic particles p flowing in the direction of the hole axis 1.0 and which exert attractive forces upon correspondingly inflowing diamagnetic particles d, as symbolized by the arrows F′m, so that the core branch flow d flowing through the pole element orifices 1′ is enriched with diamagnetic particles d, while on the other hand the branch flow p bypassing in front of the pole element orifices 1′ is depleted of diamagnetic particles or enriched with paramagnetic particles. As in the first illustrated embodiment of FIG. 1, once again it is advantageous for the hole defining edges 1.1' to be rounded off on the inflow and outflow sides, as shown. The separation modules analogous to those of FIG. 1 are given reference symbols MO1' and MO2' in FIG. 2. Once again, a separation tube TR comparable to the configuration of FIG. 3 can be assembled from these individual modules. The advantage of such a separation tube, formed of the modules MO1' or MO2' is in particular that the production of the flow guiding matrix PK/3' is more economical than that of the flow guiding matrix of FIG. 1, because only the remaining portions of a ferromagnetic perforated plate serve as the pole elements PK' and more specifically, no nozzle elements are provided in the FIG. 2 embodiment.

As already indicated, a single separation tube TR of FIG. 3, if it is provided with a suitable housing for supplying the particle-laden fluid flows A and for removing the two fractions M (the fraction enriched with paramagnetic particles) and NM (the fraction enriched with diamagnetic particles), is already capable of functioning, although it lends itself more to laboratory or experimental use. For commercial purposes, it is recommended that a multiplicity of separation tubes TR, as shown in FIGS. 5–7, be united in an axially parallel configuration into one separation tube field and combined, together with a container 100 surrounding the separation tube field into a separation canister TK. The container 100 has at least one common primary feed line or pipe fitting 11 on the top thereof and both first and second primary collecting lines 60, 70 on the bottom thereof. The descriptions of FIGS. 5 and 6 are virtually identical except for the fact that the primary feed line 11 in FIG. 5 is centrally connected to the separation canister, while on the other hand the primary feed line 11 of FIG. 6 is connected eccentrically with respect to the axis of rotation of the canister. FIGS. 5–7 do not show a high-power solenoid or magnet MM which is provided.

However, it is understood that such a high-power magnet may not only be disposed about a plurality of separation canisters disposed in axial alignment as in FIG. 8, but also about a single separation canister as in FIGS. 5–7, so that its field lines penetrate the multiple configuration of the separation tubes TR in the interior of the separation canister TK substantially in an axial direction.

It is apparent particularly from FIGS. 6 and 7 that the separation tubes TR are disposed in a hexagonal grid and that the tapering spaces remaining free between these separation tubes are divided by the bulkhead walls into tube spaces 20 taking the form of feed or collecting lines, the feed lines being in the form of the line volumes $v_1$–$v_3$, the first collecting lines being in the form of the line volumes $v_4$ and the second collecting lines being in the form of the line volumes $v_5$, $v_6$, seen in FIG. 3. The laden fluid flow A is delivered to all the feed lines $v_1$, $v_2$, $v_3$ in parallel, through the top primary feed line 11 of a forechamber 12 of the separation canister TK and from there through feed openings 10.1 provided in a suitably perforated flow guiding plate 10. The outline of the feed openings 10.1 correspond to the cross section of the tapering spaces 20 between the separation tubes TR and the bulkhead walls 9. On the bottom, two further, axially adjacent afterchambers 13, 14 are provided in the separation canister TK, as seen in FIG. 6. The afterchambers 13, 14 communicate through tapering outlet openings 30.1 or 31.1 in the perforated flow outlet plates 30, 31 with the first and second collecting lines $v_4$ or $v_5$, $v_6$, respectively, and discharge into the first primary collecting line 60 for the fraction M or the second primary collecting line 70 for the fraction NM, respectively.

The outer supporting construction for the separation canister TK of FIGS. 5–7 has been omitted from the drawing for the sake of simplification.

This also applies to the diagrammatic illustration in FIG. 8 of a separator cascade having three separation canisters TK1, TK2 and TK3, which are disposed in axial alignment one above the other and are surrounded by a high-power magnet MM having a magnetic coil or solenoid S. In this fifth illustrated embodiment, the particle-laden partial fluid flow A1 to be prepared is directed to the first canister TK1 in the form of a mixture of the fresh fluid flow A and a fluid flow M2+MN3 fed back from the outlet of the cascade. The two collected branch flows NM1 from the first canister TK1 are delivered as a fluid feed flow A2 through a line nm 12 from a pump P12 to the following second canister TK2. On the other hand, the collected first branch flows M1 from the first canister TK1 are delivered as a feed fluid flow A3 through a line M13 and a pump P13 to the third canister TK3. The collected second branch flows NM2 from the second canister TK2 and the collected first partial flows M3 from the third canister TK3 are united through two lines m2 and nm3, respectively, and fed into a return line nmm31. This feedback flow is fed, as a mixed flow M2+NM3, by the pump P31 into the line 11 and admixed with the fresh feed flow A.

Returning to the two illustrated embodiments of FIGS. 1–3, in which the core of the invention is illustrated, it becomes clear that by means of the invention a method is provided through which the particle-laden fluid flow A is delivered to the separation region in the form of a multiplicity of particle flows d+p through feed zones AO supplied from the outer periphery of the separation region and through feed openings 4 of flow guiding bodies, these feed openings being distributed over the cross section of the separation region in the form of at least one feed hole field ZL. Inside the separation region, the partial flows d+p are then delivered, through at least one separation hole field TL made up of pole element orifices 1 or 1', distributed over the cross section of the separation region, and associated wall parts 2 or 3', to ferromagnetic pole elements PK or PK' serving as a flow guiding matrix. These pole elements are penetrated in the direction of their orifice axes 1.0 by the primary magnetic flux H, and with their pole element orifices 1 or 1' corresponding to the various adjoining feed openings 4 they each divide the partial flows, containing at least two groups of particles, into at least two branch flows, as follows:

a first branch flow p (FIG. 1) or d (FIG. 2), upon which attractive forces in the direction of the pole element orifices 1 or 1' are exerted by the gradient field of the pole elements PK (FIG. 1) or PK' (FIG. 2); and a second branch flow d (FIG. 1) or p (FIG. 2), upon which repulsive forces in a direction away from the respective pole element orifice 1 or 1' are exerted by the gradient field H1 of the pole elements PK (FIG. 1) or by the gradient field H2 of the pole elements PK' (FIG. 2).

The first branch flows p (FIG. 1) or d (FIG. 2) flowing through the pole element orifices 1 or 1' and enriched with the first group of particles are directed to first collecting chambers SK2 communicating on the outlet side with the pole element orifices 1 or 1'. The second branch flows d (FIG. 1) or p (FIG. 2) deflected by the pole element orifices 1 or 1' and enriched with the second group of particles are each directed to two collecting chambers SK2, each of which include the flow volume in the separation region between the feed hole field ZL and the separation hole field TL, without the first branch flows p (FIG. 1) or d (FIG. 2) entering into the pole element orifices 1 or 1'. Finally, the first and second branch flows M or NM, united in the first and second collecting chambers SK1, SK2, are delivered to the at least one first or the at least one second collecting line $v_4$, $v_5$, or $v_6$, respectively.

The method according to the invention and the apparatus for performing it are suitable, among other purposes, for kaolin cleaning, or preparation, increasing the concentration of gold, uranium and cobalt from slag heaps, precipitating pyrite (and siderite and calcite as well) out of coal, cleaning coal in the liquefication process, recovering catalyst material in hydrogenation plants, and recovering steel particles from waste water and process powders in steel works, to name only a few applications.

The production of the perforated plates 3, 5, 3', 5' for the separation hole fields TL and feed hole fields ZL can be performed with very high precision by material machining using laser beams.

I claim:

1. Method of continuously separating magnetizable paramagnetic and diamagnetic particles including at least two groups of magnetizable particles having different respective magnetic susceptibilities, from a flowing fluid (A) laden with the particles, which comprises:

guiding a fluid flow (A) containing the at least two groups of particles through a separation region along a primary flow route (z), penetrating the flow with magnetic flux from an external high-powered magnet, guiding and reshaping the magnetic flux with a multiplicity of ferromagnetic pole elements disposed inside the separation region in a flow guiding matrix, in the following manner: penetrating the ferromagnetic pole elements with the magnetic flux thereby reshaping the primary magnetic flux of the external high-powered magnet into a multiplicity of partial fluxes with non-homogeneous field distribution, corresponding to the number and distribution of the ferromagnetic pole elements, and thereby forming a high-gradient magnetic field with regions of increased and decreased density of magnetic flux lines;

distinquishing the respective magnetic susceptibility $X_1$ or $X_2$ of the at least two groups of particles from one another with respect to the particular $X_F$ of the fluid by deflecting one group of particles in a first branch flow in the direction of increasing field gradients, and deflecting the at least one other group in a second branch flow in the direction of decreasing field gradients, at least deflecting one group as a first branch flow (p) to a greater extent than the at least one other group as a second branch flow (d), in the direction of increasing or decreasing field gradients due to differently dimensioned magnetic dipole moments of the particles in the fluid flow in the separation region;

and which further comprises:

supplying the particle-laden fluid flow (A) through feed zones (AO) supplied from the direction of the outer periphery of the separation region and through feed openings (4) in flow guiding bodies distributed over the cross section of the separation region in the form of at least one feed hole field (ZL) to the separation region in the form of a multiplicity of partial flows (d+p);

subsequently guiding the partial flows (d+p) inside the separation region through at least one separation hole field (TL) of pole element orifices (7; 7') distributed over the cross section of the separation region and associated wall parts (2) of a ferromagnetic pole element (PK; PK') as a flow guiding matrix (PK/3), penetrating the flow guiding matrix (PK/3) with the primary magnetic flux (H) in the direction of the axes (1.0) of their orifices, and dividing each of the partial flows containing at least two groups of particles into the at least two branch flows with the pole element orifices (1; 1') of the flow guiding matrix (PK/3) corresponding with the respective adjacent feed openings (4) as follows:

a first branch flow, upon which attractive forces from the gradient field of the pole element (PK) are exerted in the direction toward the pole element orifices (1; 1');

and a second branch flow, upon which repulsive forces are exerted from the gradient field of the pole element (PK), in a direction away from the respective pole element orifice (1; 1');

supplying the first branch flows flowing through the pole element orifices (1; 1') and enriched with the first group of the at least two groups of particles to first collecting chambers (SK1) communicating on the outlet side with the pole element orifices (1; 1');

supplying each of the second branch flows deflected by the pole element orifices (1; 1') and enriched with the second group of the at least two groups of particles to second collecting chambers (SK2), each of which encompass the flow volume in the separation region between the feed hole field (ZL) and the separation hole field (TL) without the first branch flows entering into the pole element orifices (1; 1');

supplying the first and second branch flows, each reunited in the first and second collecting chambers (SK1, SK2) as collected first and second branch flows (M or NM), to one of at least one first and at least one second collecting line (v4 or v5, v6), and supplying the collected first branch flow (M) enriched with the first group of particles to a first main collecting line (60), and supplying the second collected branch flow enriched with the second group of particles to a second main collecting line (70).

2. Apparatus for continuously separating magnetizable paramagnetic and diamagnetic particles includin at least two groups of magnetizable particles having different respective magnetic susceptibilities, from a flowing fluid (A) laden with the particles, comprising:

at least one separator container (TR, TK) through which the fluid flow (A) laden with particles continuously flows in at least one first and second group (p+d) along a primary flow route (z) having two ends;

said at least one separator container (TR, TK) including:

at least one separation region disposed therein, an outer periphery, at least one connection (11) for feeding the fluid flow at one of said ends of said flow route, and a fluid flow outlet divided into at least two collecting lines (v4 or v5, v6; 60 or 70) at the other of said ends of said flow route;

one of said collecting lines (v4; 60) transporting a fluid flow fraction (M) enriched with one of said at least two particle groups and the other of said collecting lines (v5, v6; 70) transporting a fluid flow fraction (MN) enriched with another of said at least two particle groups;

a flow guiding matrix (PK/3; PK'/3') disposed inside said separation region including:

at least one separation hole field (TL) having a multiplicity of ferromagnetic pole elements (PK;PK') with pole element orifices (1; 1') having axes (1.0) and being distributed over the cross section of the separation region reshaping a high-gradient magnetic field (H), and a flow guiding body having ferromagnetic pole element wall parts (2; 3') distributing said two branch flows, variously deflected at said gradient fields of said pole elements (PK; PK') to said associated collecting lines;

a high-powered magnet (MN) disposed at said outer periphery of said separator container (TR, TK), generating a primary magnetic flux being oriented in said axial direction (1.0) of said pole element orifices (1; 1') penetrating said separation region and said pole elements (PK; PK') disposed therein for forming non-homogeneous partial fluxes at said individual pole elements;

the first particle group of the at least two groups having a first magnetic susceptibility $X_1$ and the second particle group having a second magnetic susceptibility $X_2$ differing in terms of the magnetic susceptibility $X_F$ of the fluid, in such a manner that magnetic deflection forces of different strengths are exerted by the gradient fields (H, H1, H2) of said pole elements (PK; PK') upon the two groups of particles, due to different magnetic dipole moments;

a flow guiding body disposed upstream of and spaced apart (a3) fom said flow guiding matrix including at least one feed hole field plate (ZL) having feed openings (4) formed therein corrresponding to said pole element orifices (1; 1') dividing the fluid flow (A) flowing toward said feed perforation plate (ZL) from said outer periphery of said separation region through feed zones into partial flows (p+d) flowing to said pole element orifices (1; 1');

at least one first collecting chamber (SK1) having an inlet side communicating with said pole element orifices (1; 1') and being connected to one of said at least two collecting lines (v4; 60 OR v5, v6, 70); and a second collecting chamber (SK2) defined by a flow volume between said feed perforation plate (ZL) of said flow guiding body and said separation hole field (TL) of said pole element wall parts (3; 3') being connected to the other of said at least two collecting lines.

3. Apparatus according to claim 2, wherein said pole element orifices (1') and said pole element wall parts (3') of one of said at least one separation hole fields (TL) are each formed of a fine structure in form of a perforated plate having an attenuation of field lines in the vicinity of said orifices producing local gradient fields (H2) exerting repulsive forces upon paramagnetic particles flowing toward them in said axial direction (1.0) of said pole element orifices (1') and exerting attractive forces upon corresponding inflowing diamagnetic particles, for enriching one of said branch flows (d) in the form of a core branch flow flowing through said pole element orifices (1') with diamagnetic particles, and selectively depleting the other of said branch flow (p) bypassing said pole element orifices (1') of diamagnetic particles and enriching the other of said branch flows (p) bypassing said pole element orifices (1') with paramagnetic particles.

4. Apparatus according to claim 3, wherein said pole element orifices (1; 1') define rounded orifice limiting edges (1, 1') on inflow and outflow sides.

5. Apparatus according to claim 2, wherein said pole element orifices (1) and said pole element wall parts (3) of one of said at least one separation hole fields (TL) are formed of a fine structure in the form of a perforated plate having hollow conical protruding nozzles (PK) with orifices identical with said pole element orifices providing a field line compression in the vicinity of said nozzle orifices resulting in local gradient fields (H1) exerting attractive forces upon paramagnetic particles flowing inward in said axial direction (1.0) of said pole element orifices (1) and exerting repulsive forces upon correspondingly inflowing diamagnetic particles, for enriching one of said branch flows (p) in the form of a core branch flow entering through said nozzles (PK) with paramagnetic particles, depleting the other of said branch flows (d) bypassing in front of said nozzles of paramagnetic particles and enriching the other of said branch flows (d) bypassing in front of said nozzles with diamagnetic particles.

6. Apparatus according to claim 5, wherein said nozzle orifices (1) define rounded limiting edges (1.1).

7. Apparatus according to claim 2, wherein said feed openings (4) of said feed perforation plate (ZL) are coaxially with said pole element orifices (1; 1') of said separation hole field (TL).

8. Apparatus according to claim 2, wherein said flow guiding matrix (PK/3; PK'/3') is a fine structure in the form of pairs of perforated plates in which said pole element orifices (1; 1') and said pole element wall parts (3; 3') are formed, said perforated plates (3—3 or 3'-3') of said pairs being mutually spaced apart in a planar parallel fashion and congruent, defining an intervening space between the paired perforated plates serving as said first collecting chamber (SK1) for said first branch flows (p or d) and a space outside said perforated plates bordering said feed hole fields (ZL) serving as said second collecting chamber (SK2) for said second branch flows (d or p).

9. Apparatus according to claim 8, wherein said feed hole field plate (ZL) is a fine structure in the form of a pair of perforated plates, said perforated plates (5—5 or 5'—5') of said pairs being planar, mutually parallel, spaced apart and congruent, defining an intervening space between the paired perforated plates serving as a feed zone (AO).

10. Apparatus according to claim 9, wherein said flow guiding matrix (PK/3 or PK'/3') includes pairs of perforated plates (3—3 or 3'—3'), and including a plurality of identical separation modules (MO1), each formed of one of said pairs of said perforated plates (3—3 or 3'—3') of said flow guiding matrix (PK/3 or PK'/3') and one perforated plate (5 or 5') of said feed hole field (ZL) disposed on opposite sides of said pair of perforated plates, said separation modules (MO1) being stacked one on top of the other and mutually spaced (a1) apart, forming said feed zones (AO) from said mutually adjacent perforated plates of said feed hole field plates (ZL) of said successive modules.

11. Apparatus according to claim 10, wherein said stacked separation modules have an outer periphery, and including a tubular wall (7) surrounding said outer periphery of said stacked separation modules forming a separation tube (TR).

12. Apparatus according to claim 10, wherein said separation tube (TR) includes a shell (7) having slits (8) formed therein along peripheral lines dividing said shell into segments in accordance with the number and placement of said modules (MO1 or MO2) disposed therein, as follows:

first slits (8.1) for feeding the fluid flow to said feed zones (AO) of said modules from a feed line;

second slits (8.2) for removing said collected first branch flows (M or NM) collected in said first collecting chambers (SK1) of said modules, to one of said collecting lines; and third slits (8.3) for removing said second branch flows (NM or M), collected in said second collecting chambers (SK2) of said modules, to the other of said collecting lines.

13. Apparatus according to claim 12, wherein said first through third slits (8.1, 8.2, 8.3) are hexagonally distributed and each have a plurality of groups of slits distributed over said periphery of said separation tube (TR), said slits of each group of slits being located one above the other and encompassing substantially one-sixth of said periphery of said separation tube.

14. Apparatus according to claim 13, including three sector arc elements distributed over said periphery of said separation tube and associated with said first slits (8.1), one sector arc element associated with said second slits (8.2), and two sector arc elements associated with said third slits (8.3), in accordance with inflowing and outflowing quantities of fluid flow.

15. Apparatus according to claim 13, including bulkhead walls (9) sealingly secured at said outer periphery of said separation tube (TR) in radially-axially extending planes, said bulkhead walls dividing an annular chamber volume at said outer periphery of said separation tube into six different line volmmes (v1–v6) in accordance with said hexagonal slit configuration, three of said line volumes (v1–v3) communicating with said first slits (8.1) and feed lines, one of said line volumes (v4) communicating with said second slits (8.2) and forming a first collecting line, and two others of said line volumes (v5, v6) communicating with said third slits (8.3) and forming second collecting lines.

16. Apparatus according to claim 15, including additional separation tubes (TR) forming a multiplicity of separation tubes (TR) with said first-mentioned separation tube (TR) in an axially parallel configuration combined into one separation tube field with narrowing gaps therebetween in a hexagonal grid, a container (100) with a top and a bottom surrounding said separation tube field and forming a separation canister (TK) with said separation tube field, said container (100) having at least one common primary feed line (11) on said top thereof and first and second primary collecting lines (60, 70) at said bottom thereof, a high-powered solenoid (MM) surrounding said separation canister (TK) for generating the high-gradient magnetic field (H), said narrowing gaps being divided by said bulkhead walls (9) into feed or collecting lines (20), a forechamber (12) disposed in said canister at said top of said container, a flow feed plate (10) disposed in said canister below said forechamber, the laden fluid flow (A) being supplied through said primary feed line (11) to said forechamber (12) and from said forechamber to all of said feed lines (v1–v3) in parallel through corresponding perforations formed in said flow feed plate (10), two axially adjacent afterchambers (13, 14) disposed at said bottom of said container, perforated flow outlet guiding plates (30, 31) through which said afterchambers (13, 14) communicate with said first and second collecting lines (v4 or v5, v6) and discharge into said first and second primary collecting lines (60 or 70).

17. Apparatus according to claim 16, including a plurality of additional separation canisters (TK) connected together with said first-mentioned separation canister to form a separator cascade with first, second and third separation canisters, said second branch flows (NM1) being collected and flowing from said first canister (TK1) as a feed fluid flow (A2) to said second canister (TK2), said first branch flows (M1) being collected and flowing from said first canister (TK1) as a feed fluid flow (A3) to said third canister (TK3), said collected second branch flows (NM2) flowing from said second canister and said collected first partial flows (M3) selectively flowing from said third canister as a waste flow and a useful flow, and said collected first branch flows (M2) flowing from said second canister (TK2) and said collected second branch flows (NM3) flowing from said third canister (TK3) being reunited and resupplied as a feed fluid flow (A1) to said primary feed line of said first canister (TK1).

18. Apparatus according to claim 9, including a plurality of identical separation modules (MO2), each formed of one pair of perforated plates (5—5 or 5'—5') of said feed zones (AO) and one perforated plate of said separation hole fields disposed on opposite sides of said pair of perforated plates, said separation modules (MO2) being stacked on one another and mutually spaced (a2) apart, forming said first collecting chambers (SK1) of said mutually adjacent perforated plates (3 or 3') of said separation hole fields (TL) of said successive modules.

19. Apparatus according to claim 18, wherein said stacked separation modules have an outer periphery, and including a tubular wall (7) surrounding said outer periphery of said stacked separation modules forming a separation tube (TR).

20. Apparatus according to claim 18, wherein said separation tube (TR) includes a shell (7) having slits (8) formed therein along peripheral lines dividing said shell into segments in accordance with the number and placement of said modules (M01 or MO2) disposed therein, as follows:

first slits (8.1) for feeding the fluid flow to said feed zones (A0) of said modules from a feed line;

second slits (8.2) for removing said collected first branch flows (M or NM) collected in said first collecting chambers (SK1) of said modules, to one of said collecting lines; and third slits (8.3) for removing said collected second branch flows (NM or M), collected in said second collecting chambers (SK2) of said modules, to the other of said collecting lines.

21. Apparatus according to claim 20, wherein said first through third slits (8.1, 8.2, 8.3) are hexagonally distributed and each have a plurality of groups of slits distributed over said periphery of said separation tube (TR), said slits of each group of slits being located one above the other and encompassing substantially one-sixth of said periphery of said separation tube.

22. Apparatus according to claim 21, including three sector arc elements distributed over said periphery of said separation tube and associated with said first slits (8.1), one sector arc element associated with said second slits (8.2), and two sector arc elements associated with said third slits (8.3), in accordance with inflowing and outflowing quantities of fluid flow.

23. Apparatus according to claim 21, including bulkhead walls (9) sealingly secured at said outer periphery of said separation tube (TR) in radially-axially extending planes, said bulkhead walls dividing an annular chamber volume at said outer periphery of said separation tube into six different line volumes (v1–v6) in accordance with said hexagonal slit configuration, three of said line volumes (v1–v3) communicating with said first slits (8.1) and feed lines, one of said line volumes (v4) communicating with said second slits (8.2) and forming a first collecting line, and two others of said line volumes (v5, v6) communicating with said third slits (8.3) and forming second collecting lines.

24. Apparatus according to claim 23, including additional separation tubes (TR) forming a multiplicity of separation tubes (TR) with said first-mentioned separation tube (TR) in an axially parallel configuration combined into one separation tube field with narrowing gaps therebetween in a hexagonal grid, a container (100) with a top and a bottom surrounding said separation tube field and forming a separation canister (TK) with said separation tube field, said container (100) having at least one common primary feed line (11) on said top thereof and first and second primary collecting lines (60, 70) at said bottom thereof, a high-powered solenoid (MM) surrounding said separation canister (TK) for generating the high-gradient magnetic field (H), said narrowing gaps being divided by said bulkhead walls (9) into feed or collecting lines (20), a forechamber (12) disposed in said canister at said top of said container, a flow feed plate (10) disposed in said canister below said forechamber, the laden fluid flow (A) being supplied through said primary feed line (11) to said forechamber (12) and from said forechamber to all of said feed lines (v1–v3) in parallel through corresponding perforations formed in said flow feed plate (10), two axially adjacent afterchambers (13, 14) disposed at said bottom of said container, perforated flow outlet guiding plates (30, 31) through which said afterchambers (13, 14) communicate with said first and second collecting lines (v4 or v5, v6) and discharge into said first and second primary collecting lines (60 or 70).

25. Apparatus according to claim 24, including a plurality of additional separation canisters (TK) connected together with said first-mentioned separation canister to form a separator cascade with first, second and third separation canisters, said second branch flows (NM1) being collected and flowing from said first canister (TK1) as a feed fluid flow (A2) to said second canister (TK2), said first branch flows (M1) being collected and flowing from said first canister (TK1) as a feed fluid flow (A3) to said third canister (TK3), said collected second branch flows (NM2) flowing from said second canister and said collected first partial flows (M3) selectively flowing from said third canister as a waste flow and a useful flow, and said collected first branch flows (M2) flowing from said second canister (TK2) and said collected second branch flows (NM3) flowing from said third canister (TK3) being reunited and resupplied as a feed fluid flow (A1) to said primary feed line of said first canister (TK1).

26. Apparatus according to claim 2, wherein said flow guiding body for said feed hole field plate (ZL) is a fine structure in the form of a perforated plate.

27. Apparatus according to claim 2, wherein said separation hole fields and said feed hole field plates (ZL, TL) have circular outlines.

* * * * *